US010570710B2

(12) United States Patent
Zijsling

(10) Patent No.: US 10,570,710 B2
(45) Date of Patent: Feb. 25, 2020

(54) METHOD AND SYSTEM FOR SEALING A SEGMENTED EXPANDABLE CONE

(71) Applicant: SHELL OIL COMPANY, Houston, TX (US)

(72) Inventor: Djurre Hans Zijsling, Rijwsijk (NL)

(73) Assignee: SHELL OIL COMPANY, Houston, TX (US)

( * ) Notice: Subject to any disclaimer, the term of this patent is extended or adjusted under 35 U.S.C. 154(b) by 96 days.

(21) Appl. No.: 15/740,091

(22) PCT Filed: Jun. 28, 2016

(86) PCT No.: PCT/EP2016/064984

§ 371 (c)(1),
(2) Date: Dec. 27, 2017

(87) PCT Pub. No.: WO2017/001389

PCT Pub. Date: Jan. 5, 2017

(65) Prior Publication Data

US 2018/0187526 A1 Jul. 5, 2018

(30) Foreign Application Priority Data

Jul. 1, 2015 (EP) ..... 15174890

(51) Int. Cl.

| | |
|---|---|
| ***E21B 17/14*** | (2006.01) |
| ***E21B 29/10*** | (2006.01) |
| ***E21B 43/10*** | (2006.01) |
| *E21B 33/124* | (2006.01) |

(52) U.S. Cl.

CPC ..... *E21B 43/105* (2013.01); *E21B 17/14* (2013.01); *E21B 29/10* (2013.01); *E21B 43/108* (2013.01); *E21B 33/1243* (2013.01)

(58) Field of Classification Search

CPC ..... E21B 43/105; E21B 17/14; E21B 29/10; E21B 43/108

See application file for complete search history.

(56) References Cited

U.S. PATENT DOCUMENTS

| | | | | |
|---|---|---|---|---|
| 2005/0045342 | A1 | 3/2005 | Luke et al. | |
| 2012/0085549 | A1 | 4/2012 | O'Connor et al. | |
| 2013/0048308 | A1 | 2/2013 | Lehr et al. | |
| 2013/0299197 | A1 | 11/2013 | Bennett | |
| 2014/0041880 | A1 | 2/2014 | Noel et al. | |
| 2014/0216759 | A1* | 8/2014 | Jacob | E21B 23/00 166/382 |

FOREIGN PATENT DOCUMENTS

| | | | |
|---|---|---|---|
| EP | 0881354 | A2 | 12/1998 |
| WO | 2008135538 | A2 | 11/2008 |

OTHER PUBLICATIONS

International Search Report and Written Opinion received for PCT Patent Application No. PCT/EP2016/064984, dated Nov. 21, 2016, 11 pages.

* cited by examiner

*Primary Examiner* — Taras P Bemko
*Assistant Examiner* — Dany E Akakpo

(57) ABSTRACT

A well tubular is expanded using an expandable segmented cone (301-303) which is at a large diameter bottom or gauge section of the cone (301-303) provided with a robust sealing assembly (300A-C) comprising a sealing ring or sealing lips that engage(s) an expanded section of the tubular (307).

6 Claims, 3 Drawing Sheets

Fig.1
Prior art Expandable cone disclosed in US201213467612
Fig.1a
Collapsed cone in liner
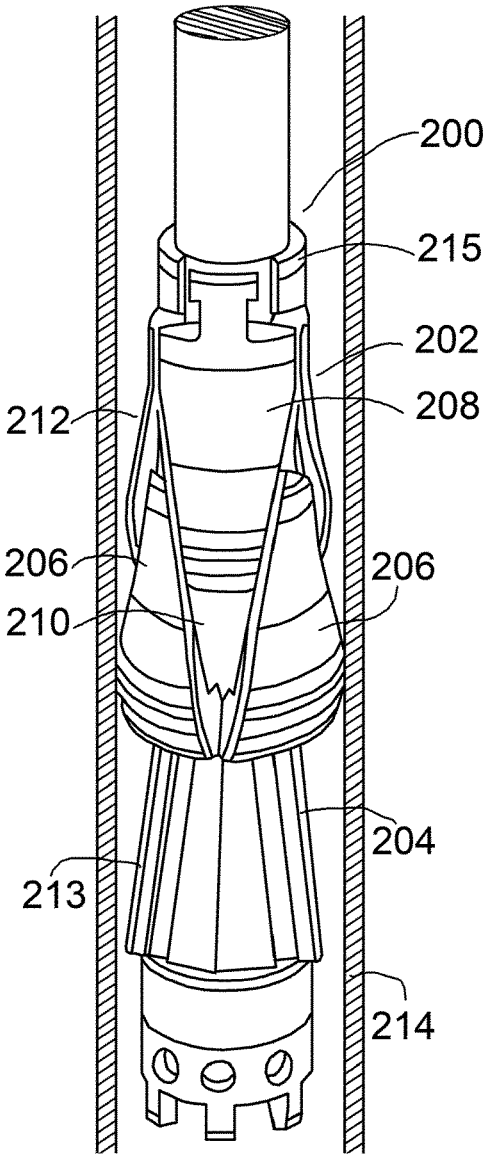
Fig.1b
Partly assembled
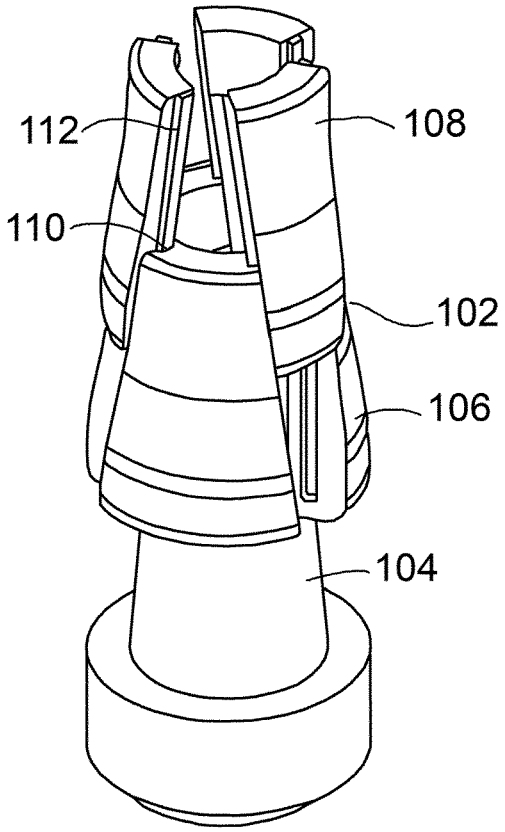
Fig.1c
Fully assembled and suspended
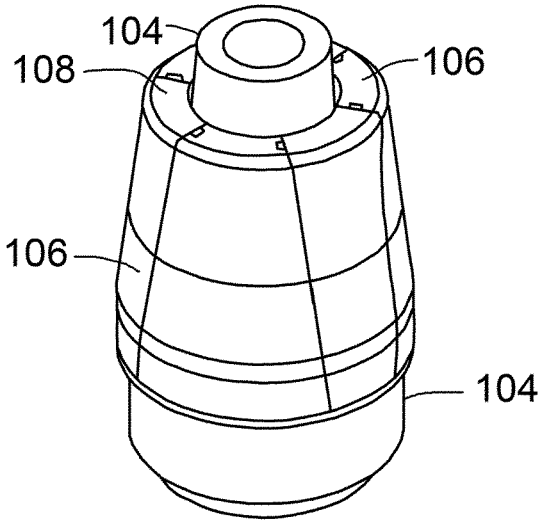

Activation of hydraulic seal below cone

Segments contact seal

Seal crushes

Seal in end position;
seal fully crushed
302,303
307
300A
300C
300B
300
304
306
301

Fig.3
Elastomers for sealing the cone
Fig.3a
O-ring in shoulder + elastomer strips between segments
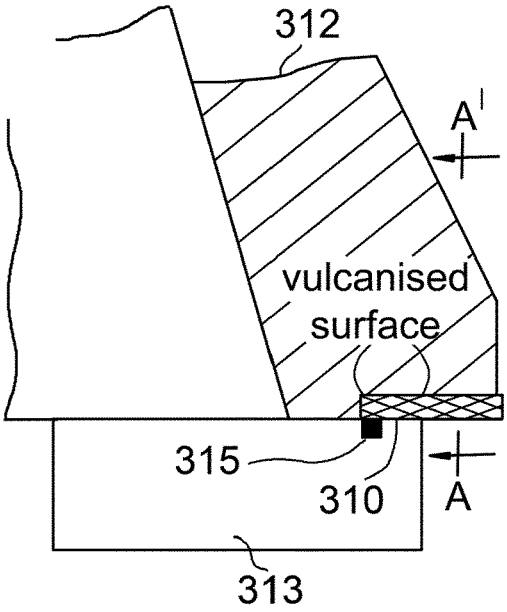
Fig.3b
Cross-section A-A'
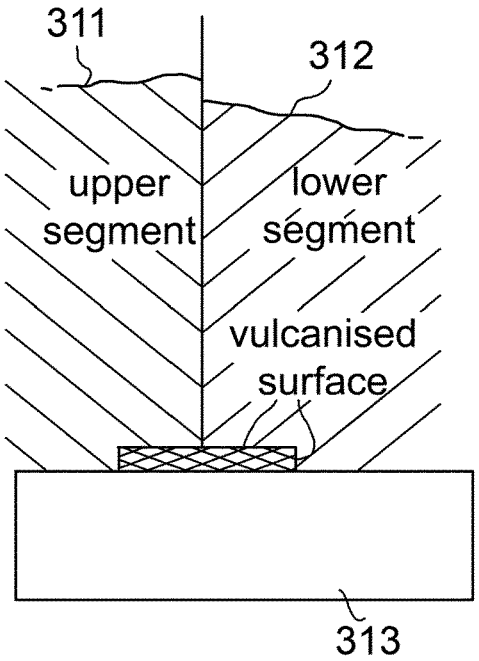
Fig.4
Radial seal between segments
Fig.4a
O-ring seal + radial strip seal
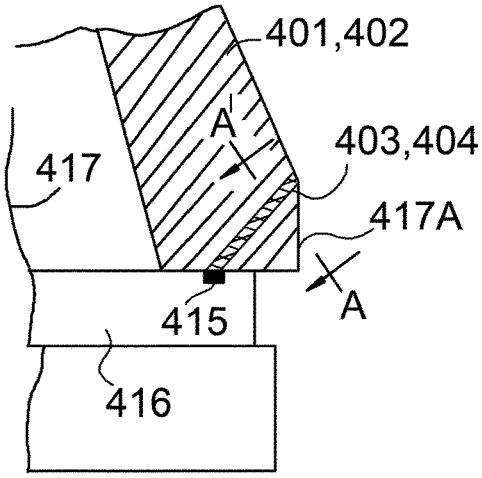
Fig.4b
Cross-section A-A' before and contact between segments
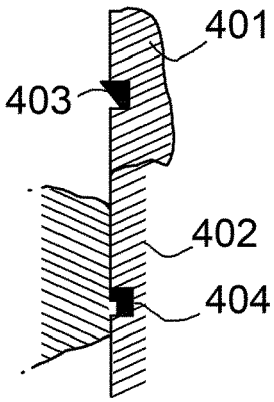

METHOD AND SYSTEM FOR SEALING A SEGMENTED EXPANDABLE CONE

CROSS REFERENCE TO EARLIER APPLICATIONS

This is a National phase application of International Application PCT/EP2016/064984, filed 28 Jun. 2016, which claims priority of European application 15174890.2, filed 1 Jul. 2015.

FIELD OF THE INVENTION

This invention relates to a method for expanding a well tubular in which a sealing assembly is employed to move an expandable segmented cone though the tubular. The invention further relates to expandable segmented cones comprising a sealing assembly to move the segmented cone through a tubular.

BACKGROUND OF THE INVENTION

Reference is made to U.S. patent applications US 2012/13467612 A and US 2013/299197 A. The cones described in these references are provided with a seal arranged at a small diameter top end of the cone, which seal is configured to engage a small diameter unexpanded tubular section in front of the cone.

A disadvantage of these known cones is that when the seal reaches the unexpanded end of the otherwise expanded tubular the seal pops out of the tubular thereby stalling the hydraulic propulsion of the cone through the tubular.

Other known expandable cones provided with expandable sealing assemblies are disclosed in US patent applications US2013/048308 and US2005/045342 and European patent application EP0881354.

A disadvantage of these known expandable sealing assemblies is that they are prone to wear and leakage There is a need for an improved expandable cone and method for sealing such an expandable cone which overcomes these advantages and provides an expandable cone that does not stall at the unexpanded end of the otherwise expanded tubular and that is provided with robust seals that are not prone to leakage.

SUMMARY OF THE INVENTION

In accordance with the invention there is provided a method for expanding a well tubular with an expandable segmented cone that comprises a sealing assembly to move the expanded cone through the tubular by creating a pressure difference across the cone, wherein the sealing assembly is arranged at a large diameter bottom section of the cone and engages an expanded section of the tubular.

The cone furthermore comprises a set of upwardly tapered lower segments and a complementary set of downwardly tapered upper segments, which sets are slidably arranged on an in upward direction inwardly tapered conical surface of a cone carrier body such that in an upper position the segments are staggered and retracted and in a lower position the segments are circumferentially aligned and expanded against a lower support shoulder of the carrier body below the tapered conical surface thereof and wherein the sealing assembly is arranged at or adjacent to the lower support shoulder; and wherein:

A) the sealing assembly comprises a sealing ring, which is upon expansion of the cone squeezed between the lower ends of the segments and the lower support shoulder and thereby deformed such that its outer diameter is increased; or B) the sealing assembly comprises sealing lips arranged at or near the lower ends of segments such that upon expansion of the cone the sealing lips are circumferentially aligned and provide a fluid tight seal, which the sealing lips are upon expansion of the cone squeezed against the lower support shoulder.

In accordance with the invention there is furthermore provided an expandable segmented cone for expanding a well tubular that comprises a sealing assembly to move the expanded cone through the tubular by creating a pressure difference across the cone, wherein the sealing assembly is arranged at a large diameter bottom section of the cone and is configured to engage an expanded section of the tubular; and A)the sealing assembly comprises a sealing ring, which is upon expansion of the cone squeezed between the lower ends of the segments and the lower support shoulder and thereby deformed such that its outer diameter is increased; or B)the sealing assembly comprises sealing lips arranged at or near the lower ends of segments such that upon expansion of the cone the sealing lips are circumferentially aligned and provide a fluid tight seal, which sealing lips are upon expansion of the cone squeezed against the lower support shoulder.

These and other features, embodiments and advantages of the method and expandable cone according to the invention are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects. Objects and other features depicted in the figures and/or described in this specification, abstract and/or claims may be combined in different ways by a person skilled in the art.

BRIEF DESCRIPTION OF THE DRAWINGS

FIGS. 1*a*-1*c* show a segmented expandable cone known from US patent application US201213467612;

FIGS. 3*a* and 3*b* show longitudinal sectional views of a cone provided with an alternative embodiment of a large diameter sealing assembly; and FIGS. 4*a* and 4*b* show longitudinal sectional views of yet another alternative embodiment of a cone provided with a large diameter sealing assembly.

DETAILED DESCRIPTION OF THE DEPICTED EMBODIMENTS

Figures 2, 2A, 2B, 2C:
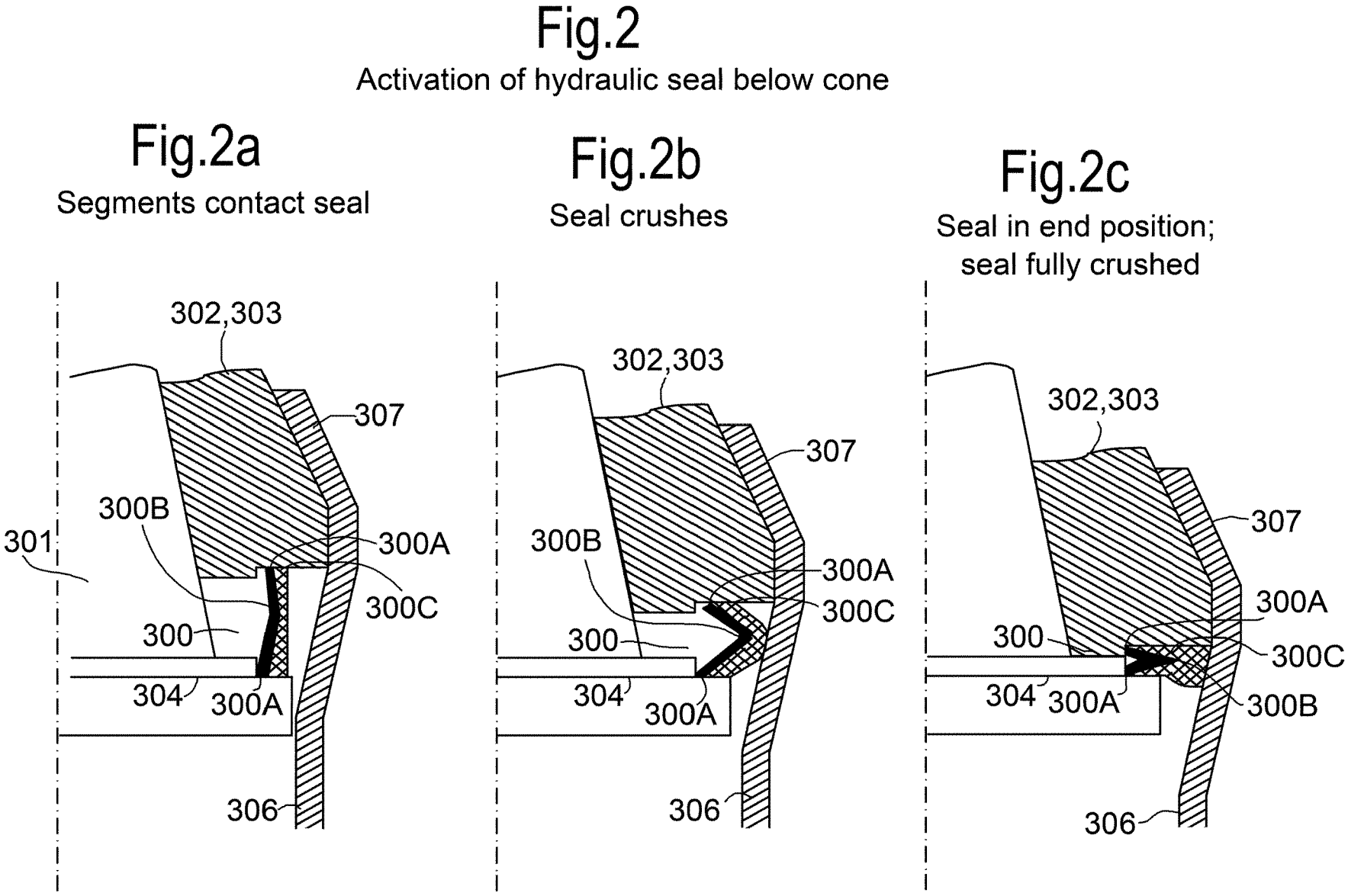
FIGS. 2*a*-2*c* show longitudinal sectional views of a cone provided with a large diameter sealing assembly.

The present disclosure involves sealing of a segmented expandable cone such that a pressure difference can be created across the cone to move the cone through a well tubular that is expanded by the cone. Two options are proposed:

A)the sealing assembly comprises a sealing ring, which is upon expansion of the cone squeezed between the lower ends of the segments and a lower support shoulder and thereby deformed such that its outer diameter is increased; or B) the sealing assembly comprises sealing lips arranged at or near the lower ends of segments such that upon expansion of the cone the sealing lips are circumferentially aligned and provide a fluid tight seal, which the sealing lips are upon expansion of the cone squeezed against a lower support shoulder.

If option A applies the sealing assembly may comprise a V-shaped sealing ring, which is upon expansion of the cone squeezed between the lower ends of the segments and the lower support shoulder and thereby deformed such that its outer diameter is increased. The V-shaped sealing ring may have a V-shaped longitudinal sectional profile such that when the sealing ring is squeezed the tips of the V-shaped sections are moved towards each other, thereby pushing a rubber coated central edge of the profile in a radial outward direction against an inner surface of the expanded tubular.

Where option B applies the sealing lips may upon expansion of the cone be squeezed against an O-ring embedded in a circular groove in the lower support shoulder.

FIGS. 1*a*-1*c* show a segmented expandable cone 202 known from US patent application US201213467612.

The known cone comprises a set of upwardly tapered lower segments 106, 206 and a complementary set of downwardly tapered upper segments 108, 208, which sets are slidably arranged on an in upward direction inwardly tapered conical surface 104 of a cone carrier body such that in an upper position shown in Figure la the segments 206 and 208 are staggered and retracted and in a lower position shown in FIG. 1*c* the segments 106, 206, 108 and 208 are circumferentially aligned and expanded against a lower support shoulder of the carrier body below the tapered conical surface 104 thereof. The known segmented expandable cone 202 comprises a sealing assembly 212 arranged at a small diameter top section of the cone 202 and configured to engage an unexpanded small diameter section of the tubular 214.

FIGS. 2*a*-2*c* show longitudinal sectional views of a cone provided with a large diameter sealing assembly according to the present invention. The large diameter sealing assembly comprises a sealing ring 300, which is upon expansion of the cone 301 squeezed between the lower ends of the segments 302 and 303 and the lower support shoulder 304 and thereby deformed such that its outer diameter is increased as illustrated in FIG. 2*c*. FIGS. 2*a*-2*c* further show that the sealing ring 300 has a V-shaped longitudinal sectional profile such that when the sealing ring 300 is squeezed between the shoulder 304 and lower ends of the expanded segments 302 and 303 as illustrated in FIGS. 2*b* and 2*c* the tips 300A of the V-shaped sections are moved towards each other, thereby pushing the central edge 300B of the profile in a radial outward direction against an inner surface 306 of the expanded tubular 307.

The sealing ring 300 comprises a V-shaped circular steel sleeve (300A-300B) which is coated with a layer of elastomer (300). The shape of the sleeve (300A-300B) may be such that upon application of an axial load it will crush with a preferential outward direction increasing the diameter at location 300B while the end of the sleeve 300A does not move radially during the crushing.

The thus generated V-shaped seal may be self-energizing such that the contact pressure with the expanded liner generates an initial seal and the V-shaped circular steel sleeve (300A-300B) and elastomeric coating (300C) are configured such that the hydraulic pressure under the cone further buckles the sleeve (300A-300B) and squeezes the rubber coating (300C) against the expanded liner 307 and thereby enhances the sealing performance of the seal. FIGS. 3*a* and 3*b* show longitudinal sectional views of a cone provided with an alternative embodiment of a large diameter sealing assembly according to the present invention, wherein the sealing assembly comprises sealing lips 310 arranged at or near the lower ends of upper and lower segments 311 and 312 such that upon expansion of the cone the sealing lips 310 are circumferentially aligned and provide a fluid tight seal that is squeezed against the lower support shoulder 313. FIG. 3*a* also shows that the sealing lips 310 are upon expansion of the cone squeezed against an O-ring 315 embedded in a circular groove in the lower support shoulder 313.

The embodiment shown in FIGS. 3*a* and 3*b* provides an expandable segmented cone (301-303) with a sealing assembly (300A-C) at a large diameter bottom or gauge section of the cone (301-303), which sealing assembly (300A-C) engages an expanded section of the tubular (307) thereby providing a seal that preserves a pressure difference across the cone when the cone (301-303) reaches an unexpanded end of the otherwise expanded tubular (307).

FIGS. 4*a* and 4*b* show longitudinal sectional views of yet another alternative embodiment of a cone provided with a large diameter sealing assembly according to the present invention, wherein the adjacent side surfaces 401 and 402 of adjacent upper and lower cone segments are provided with slant outwardly directed grooves in which sealing lips 403, 404 are arranged, which upon expansion of the cone as illustrated in FIG. 4*a* engage each other and also engage an O-ring 415 embedded in a circular groove in the lower support shoulder 416 of the expandable cone assembly 417 to provide a fluid tight seal at a large diameter section 417A of the expanded cone assembly 417.

The proposed expansion method and cone may be used to expand a tubular within the wellbore to create a large or Mono Diameter (MOD) wellbore, which is, after completion, used for producing a larger amount of crude oil, natural gas and/or other hydrocarbon fluids than conventional telescoping wells in which no tubulars are expanded.

Therefore, the method, cone and/or any products according to present invention are well adapted to attain the ends and advantages mentioned as well as those that are inherent therein.

The particular embodiments disclosed above are illustrative only, as the present invention may be modified, combined and/or practiced in different but equivalent manners apparent to those skilled in the art having the benefit of the teachings herein.

Furthermore, no limitations are intended to the details of construction or design herein shown, other than as described in the claims below.

It is therefore evident that the particular illustrative embodiments disclosed above may be altered, combined and/or modified and all such variations are considered within the scope of the present invention as defined in the accompanying claims.

While any methods, systems and/or products embodying the invention are described in terms of "comprising," "containing," or "including" various described features and/or steps, they can also "consist essentially of" or "consist of" the various described features and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b")

disclosed herein is to be understood to set forth every number and range encompassed within the broader range of values.

Also, the terms in the claims have their plain, ordinary meaning unless otherwise explicitly and clearly defined by the patentee.

Moreover, the indefinite articles "a" or "an", as used in the claims, are defined herein to mean one or more than one of the element that it introduces.

If there is any conflict in the usages of a word or term in this specification and one or more patent or other documents that may be cited herein by reference, the definitions that are consistent with this specification should be adopted.

The invention claimed is:

1. A method for expanding a well tubular with an expandable segmented cone, comprising:

providing the expandable segmented cone that comprises:

a cone carrier body having an conical surface that is inwardly tapered in an upward direction;

a set of upwardly tapered lower segments and a complementary set of downwardly tapered upper segments, which sets are slidably arranged on the conical surface of the cone carrier body, such that, in an upper position, the lower segments and the upper segments are mutually staggered and retracted, and, in a lower position, the lower segments and the upper segments are circumferentially aligned and expanded against a lower support shoulder of the carrier body below the tapered conical surface thereof; and a sealing assembly arranged at a large diameter bottom section of the cone at or adjacent to the lower support shoulder, and comprising a sealing ring, which is, upon expansion of the cone, squeezed between the lower ends of the lower segments and the upper segments and the lower support shoulder and thereby deformed such that an outer diameter of the sealing ring is increased, wherein the sealing ring has a V-shaped steel support body with a longitudinal section profile such that, when the sealing ring is squeezed, the V-shaped support body buckles such that tips of the V-shaped support body are moved towards each other, thereby pushing a rubber coated central edge of the V-shaped support body in a radial outward direction against an inner surface of the expanded tubular;

activating the sealing ring by expanding the cone;

engaging the sealing assembly against an expanded section of the tubular; and moving the expanded cone through the tubular by creating a pressure difference across the cone thereby expanding an unexpected end of the well tubular.

2. The method of claim 1, further comprising: expanding the tubular within a wellbore, thereby creating a large or Mono Diameter wellbore, which is, after completion, used for producing a larger amount of crude oil, natural gas and/or other hydrocarbon fluids than conventional telescoping wells in which no tubulars are expanded.

3. An expandable segmented cone for expanding a well tubular, the expandable segmented cone comprising:

a cone carrier body having a conical surface that is inwardly tapered in an upward direction, a set of upwardly tapered lower segments and a complementary set of downwardly tapered upper segments, which sets are slideably arranged on the conical surface of the cone carrier body, such that, in an upper position, the lower segments and the upper segments are mutually staggered and retracted, and, in a lower position, the lower segments and the upper segments are circumferentially aligned and expanded against a lower support shoulder of the carrier body below the tapered conical surface thereof; and a sealing assembly arranged at a large diameter bottom section of the cone at or adjacent to the lower support shoulder, and comprising a sealing ring, which is, upon expansion of the cone, squeezed between the lower ends of the lower segments and the upper segments and the lower support shoulder and thereby deformed such that an outer diameter of the sealing ring is increased, wherein the sealing ring has a V-shaped steel support body with a longitudinal sectional profile such that, when the sealing ring is squeezed, the V-shaped support body buckles such that tips of the V-shaped support body are moved towards each other, thereby pushing a rubber coated central edge of the V-shaped support body in a radial outward direction against an inner surface of the expanded tubular.

4. A method for expanding a well tubular with an expandable segmented cone, comprising:

providing the expandable segmented cone that comprises:

a cone carrier body having a conical surface that is inwardly tapered in an upward direction;

a set of upwardly tapered lower segments and a complementary set of downwardly tapered upper segments, which sets are slidably arranged on the conical surface of the cone carrier body, such that, in an upper position, the lower segments and the upper segments are mutually staggered and retracted, and, in a lower position, the lower segments and the upper segments are circumferentially aligned and expanded against a lower support shoulder of the carrier body below the tapered conical surface thereof; and a sealing assembly arranged at a large diameter bottom section of the cone at or adjacent to the lower support shoulder, and comprising sealing lips arranged at or near the lower ends of the lower segments and the upper segments such that, upon expansion of the cone, the sealing lips are circumferentially aligned and provide a fluid tight seal and are squeezed against the lower support shoulder, wherein, upon expansion of the cone, the sealing lips are squeezed against an O-ring embedded in a circular groove in the lower support shoulder;

activating the sealing lips by expanding the cones;

engaging the sealing assembly against an expanded section of the tubular; and moving the expanded cone through the tubular by creating a pressure difference across the cone, thereby expanding an unexpected end of the well tubular.

5. The method of claim 4, further comprising: expanding the tubular within a wellbore, thereby creating a large or Mono Diameter wellbore, which is, after completion, used for producing a larger amount of crude oil, natural gas and/or other hydrocarbon fluids than conventional telescoping wells in which no tubulars are expanded.

6. An expandable segmented cone for expanding a well tubular, the expandable segmented cone comprising:

a cone carrier body having a conical surface that is upwardly tapered in an upward direction; and a set of upwardly tapered lower segments and a complementary set of downwardly tapered upper segments, which sets are slideably arranged on the conical surface of the cone carrier body, such that, in an upper position, the lower segments and the upper segments are mutually staggered and retracted, and, in a lower position, the lower segments and the upper segments are circumferentially aligned and expanded against a lower support shoulder of the carrier body below the tapered conical surface thereof; and a sealing assembly arranged at a large diameter bottom section of the cone at or adjacent to the lower support shoulder, and comprising sealing lips arranged at or near the lower ends of the lower segments and the upper segments such that, upon expansion of the cone, the sealing lips are circumferentially aligned and provide a fluid tight seal and squeezed against the lower support shoulder, wherein, upon expansion of the cone, the sealing lips are squeezed against an O-ring embedded in a circular groove in the lower support shoulder.

* * * * *